US010283096B2

(12) United States Patent
Miyajima

(10) Patent No.: US 10,283,096 B2
(45) Date of Patent: May 7, 2019

(54) DRUM MOUNTING DEVICE AND DRUM

(71) Applicant: HOSHINO GAKKI CO., LTD., Nagoya, Aichi (JP)

(72) Inventor: Hideyuki Miyajima, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 15/846,223

(22) Filed: Dec. 19, 2017

(65) Prior Publication Data

US 2019/0066635 A1 Feb. 28, 2019

(30) Foreign Application Priority Data

Aug. 28, 2017 (JP) ..... 2017-163268

(51) Int. Cl.
*G10D 13/02* (2006.01)

(52) U.S. Cl.
CPC ..... *G10D 13/026* (2013.01)

(58) Field of Classification Search
CPC ..... G10D 13/026
USPC ..... 84/421
See application file for complete search history.

(56) References Cited

U.S. PATENT DOCUMENTS 4,158,980 A 6/1979 Gauger
5,046,700 A 9/1991 Hoshino
6,075,190 A * 6/2000 Mosser ..... F16C 11/103 248/291.1
9,613,603 B2 4/2017 Allen

* cited by examiner

*Primary Examiner* — Jianchun Qin

(57) ABSTRACT

A bracket includes a base that is fixed to the outer circumferential surface of a shell, a fixing member that is fixed to a rod portion of a holder or a drum stand, a shaft that couples the base and the fixing member to each other, and a fixing tool for fixing the fixing member to the rod portion. The base and the fixing member are coupled to each other by the shaft to be pivotal relative to each other about a horizontal axis that is perpendicular to the axis of the shell.

6 Claims, 5 Drawing Sheets

DRUM MOUNTING DEVICE AND DRUM

CROSS-REFERENCE TO RELATED APPLICATIONS

This application is based upon and claims the benefit of priority from prior Japanese Patent Application No. 2017-163268, filed on Aug. 28, 2017, the entire contents of which are incorporated herein by reference.

BACKGROUND OF THE INVENTION

The present invention relates to a drum mounting device, which is used to mount a drum such as a tom-tom to a bass drum or a stand, and to a drum.

A drum such as a tom-tom is played by striking the drum head with a stick. At this time, if the drum as a whole sways in correspondence with the direction in which the drum head is struck, the feeling of striking is improved and the sound quality and resonance of the drum are improved. Also, by restraining transmission of the vibration, which is caused by striking the drum head, from the shell to the holder or the stand, the sound quality and resonance of the drum are further improved.

The bracket disclosed in U.S. Pat. No. 5,046,700 includes a rod clamping portion, two upper and lower vibration absorbing seat portions, plates, and bolts. The vibration absorbing seat portions are integrated with the rod clamping portion. The plates are each embedded in the corresponding one of the vibration absorbing seat portions. The bolts are each fixed to the corresponding one of the plates. The bracket is fixed by fastening a nut onto each of the bolts from the inner side of the shell in a state in which the two upper and lower vibration absorbing seat portions are held in tight contact with the outer circumferential surface of the shell.

The bracket disclosed in U.S. Pat. No. 9,613,603 includes one of the lugs fixed to the outer circumferential surface of a shell, a rod clamping member mounted to the lug, and a vibration insulating member arranged between the lug and the rod clamping member. The vibration insulating member is configured by a first metal washer element and a second metal washer element. The first and second metal washer elements are engaged with a horizontal pin and a vertical pin, respectively. The horizontal pin and the vertical pin couple the lug and the rod clamping member to each other.

The bracket disclosed in U.S. Pat. No. 4,158,980 includes an arcuate arm, which is mounted to metal parts separated apart on the outer circumferential surface of the shell and the upper hoop by means of a lug bolt. A plate portion, which has a rectangular shape as viewed from above, extends downward from the middle of the arm. A rectangular pillar-shaped connector, to which a rod is fixed, is fixed to the plate portion via a rubber member.

A bracket 70 shown in FIG. 7 includes a metal body portion 71, which is substantially U-shaped, and a rod clamping portion 72, which is mounted to the body portion 71. The bracket 70 is fixed from the inner side of a shell S by means of two mounting screws in a state in which the body portion 71 is held in contact with the outer circumferential surface of the shell S.

However, neither the bracket disclosed in U.S. Pat. No. 5,046,700 nor the bracket disclosed in U.S. Pat. No. 4,158,980 is configured to sway the drum as a whole in correspondence with the striking direction in which the drum head is struck. That is, neither of these brackets is configured to control the vibrating direction of the drum to be the same as the striking direction. If a drum is mounted to a holder or a stand using such brackets, the position of the striking surface of the drum head cannot be stabilized at the time the player rolls the drum head. This hampers drum playing and swells the sound of the drum, thus deteriorating the sound quality of the drum.

In the bracket of U.S. Pat. No. 9,613,603, not only the horizontal sway of the drum is restricted by the first metal washer element, which is engaged with the horizontal pin, but also the vertical sway of the drum is restricted by the second metal washer element, which is engaged with the vertical pin. This hampers sway of the drum as a whole in every direction. As a result, the feeling of striking the drum and the sound quality and resonance of the drum are undesirable.

In contrast, if the drum is mounted to a holder or a stand using the bracket 70 of FIG. 7, the substantially U-shaped body portion 71 allows the drum as a whole to sway in correspondence with the direction in which the drum head is struck. However, in this case, since the body portion 71 is made of metal, the sway of the drum as a whole is limited. Also, since the bracket 70 is incapable of sufficiently controlling the vibrating direction of the drum, the bracket 70 cannot improve the sound quality and resonance of the drum sufficiently. Further, since the bracket 70 lacks a vibration absorbing member, the vibration is easily transmitted from the drum to the holder or the stand through the body portion 71, which is made of metal.

SUMMARY OF THE INVENTION

Accordingly, it is an objective of the present invention to provide a drum mounting device and a drum that are capable of improving the feeling of striking the drum and the sound quality and resonance of the drum.

To achieve the foregoing objective and in accordance with a first aspect of the present disclosure, a drum mounting device for mounting a drum to an object of installation in which the drum is to be installed is provided. The drum mounting device includes a base, which is fixed to the drum, and a fixing member, which is joined to the base and is fixed to a pillar-shaped object arranged in the mount object. The base and the fixing member are coupled to each other to be pivotal relative to each other about a horizontal axis, which is perpendicular to an axis of a shell of the drum.

To achieve the foregoing objective and in accordance with a second aspect of the present disclosure, a drum is provided that includes a mounting device for mounting the drum in a mount object in which the drum is to be installed. The mounting device includes a base, which is fixed to the drum, and a fixing member, which is joined to the base and is fixed to a pillar-shaped object arranged in the mount object. The base and the fixing member are coupled to each other to be pivotal relative to each other about a horizontal axis, which is perpendicular to an axis of a shell of the drum.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A drum mounting device according to one embodiment of the present invention will now be described with reference to FIGS. 1 to 6.

Figure 1:
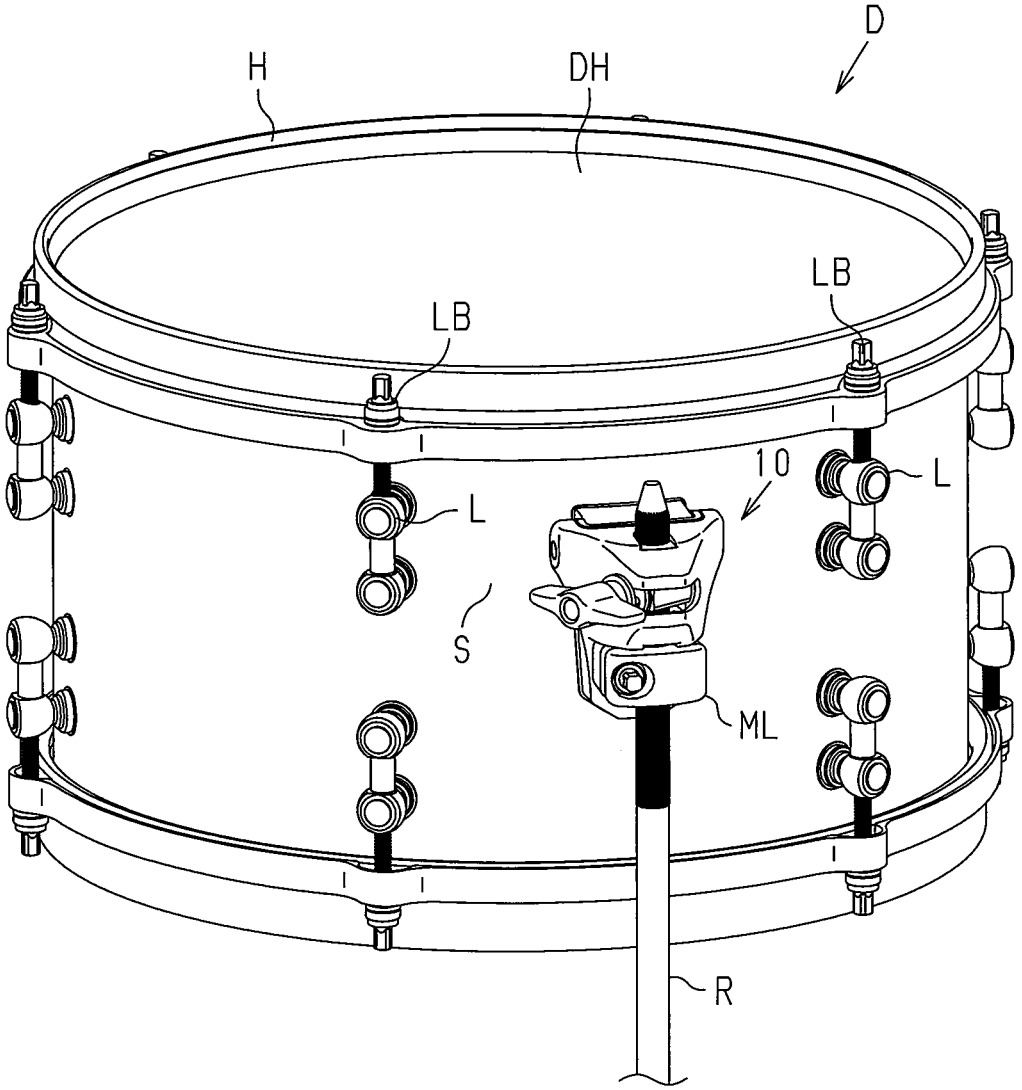
FIG. 1 is a perspective view of a drum including a bracket according to one embodiment of the present invention.

As shown in FIG. 1, a drum D includes a cylindrical shell S, a drum head DH, which closes an opening end of the shell S, and a hoop H, which is attached around the opening end of the shell S. The drum D also includes lugs L, which are fixed to the outer circumferential surface of the shell S, and lug bolts LB, each of which is threaded to the corresponding one of the lugs L. By fastening the lug bolts LB, the drum head DH, together with the hoop H, is fixed to the opening end of the shell S. Also, by adjusting the fastening amount of the lug bolts LB, the tensile force of the drum head DH is changed.

The drum D also includes a bracket 10 as a mounting device. The bracket 10 is a drum part independent of the lugs L and the lug bolts LB. Therefore, the bracket 10 is fixed at a position on the outer circumferential surface of the shell S that is separated from the lugs L and the lug bolts LB. The drum D is mounted to a bass drum or a stand, which serves as a mount object, by means of the bracket 10. At this time, the bracket 10 is fixed to a rod portion R of either a holder fixed to the bass drum or a drum stand. A memory lock ML is attached to the rod portion R, which is a pillar-shaped object, to memorize the mount position of the drum D.

Figure 2:
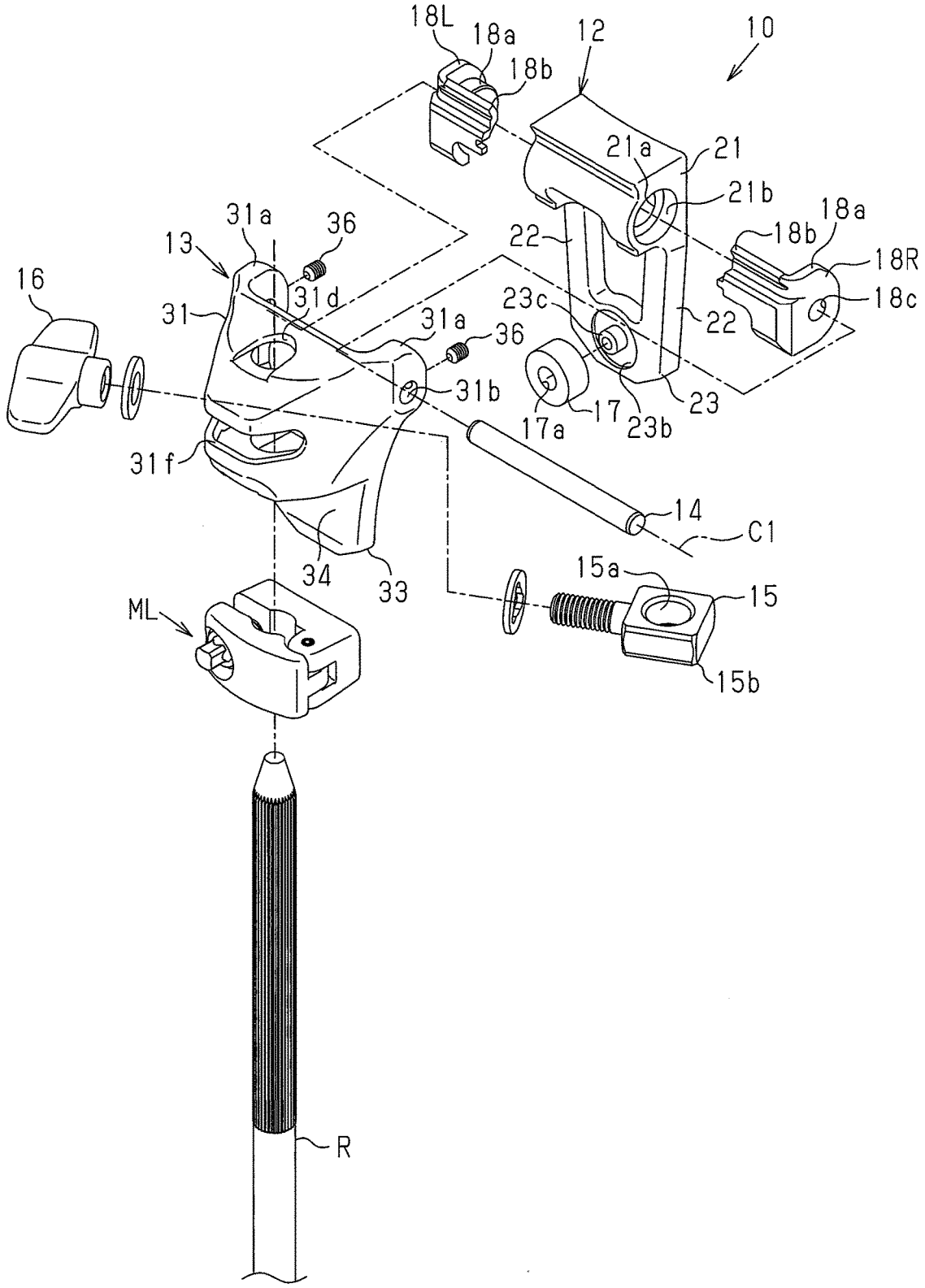
FIG. 2 is an exploded perspective view of the bracket.
Figure 3:
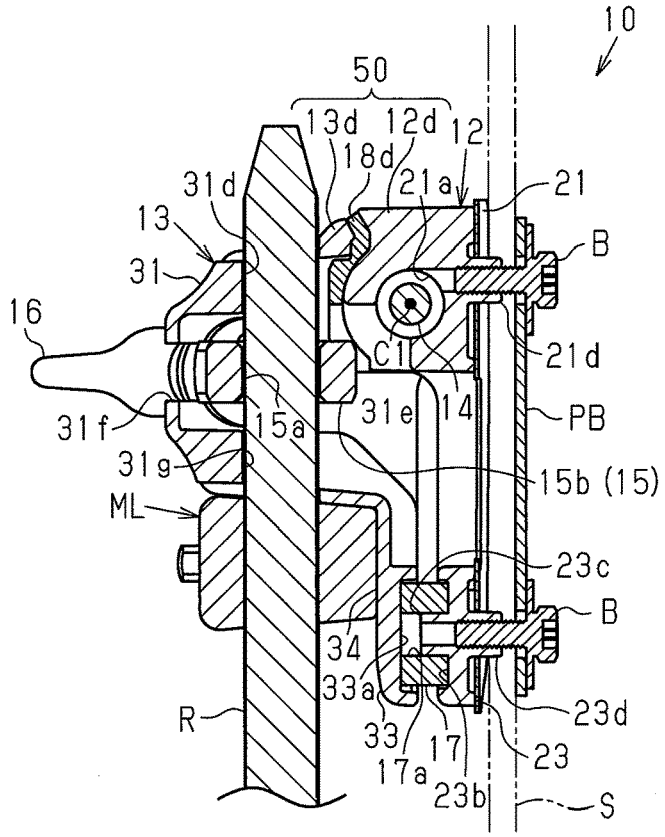
FIG. 3 is a longitudinal cross-sectional view of the bracket.

With reference to FIGS. 2 and 3, the bracket 10 includes a base 12, a fixing member 13, a shaft 14, and a fixing tool. The base 12 is fixed to the outer circumferential surface of the shell S. The fixing member 13 is fixed to the rod portion R. The shaft 14 couples the base 12 and the fixing member 13 to each other. The fixing tool is used to fix the fixing member 13 to the rod portion R. The fixing tool is configured by a screw 15 and a wing nut 16, which is threaded to the screw 15. A block body 15*b*, which is shaped as a rectangular parallelepiped and has a vertical hole 15*a*, is formed in the proximal end of the screw 15.

The bracket 10 also includes vibration absorbing members between the base 12 and the fixing member 13. The bracket 10 is thus configured to be capable of absorbing vibration caused by striking the drum D. The bracket 10 includes, as the vibration absorbing members, a cylindrical first vibration absorbing member 17 and two left and right second vibration absorbing members 18L, 18R, each of which is substantially L-shaped. The hardness of the first vibration absorbing member 17 is lower than the hardness of each of the second vibration absorbing members 18L, 18R. Elastic material such as polyurethane, rubber, or elastomer is used for the first vibration absorbing member 17 and the second vibration absorbing members 18L, 18R.

The base 12 is shaped like a vertically elongated rectangular frame. The base 12 includes an upper portion 21, two pillar-shaped portions 22, and a lower portion 23. The upper portion 21 configures a coupling portion with respect to the fixing member 13. The pillar-shaped portions 22 extend downward from the upper portion 21. The lower portion 23 couples the lower ends of the two pillar-shaped portions 22 to each other. A threaded portion 21*d* and a threaded portion 23*d*, which project toward the inner side of the shell S, are formed in the upper portion 21 and the lower portion 23, respectively. The base 12 is fixed to the outer circumferential surface of the shell S by fastening bolts B, which extend through a pressing plate PB and the shell S from the inner side of the shell S, to the corresponding threaded portions 21*d*, 23*d*.

Figure 4:
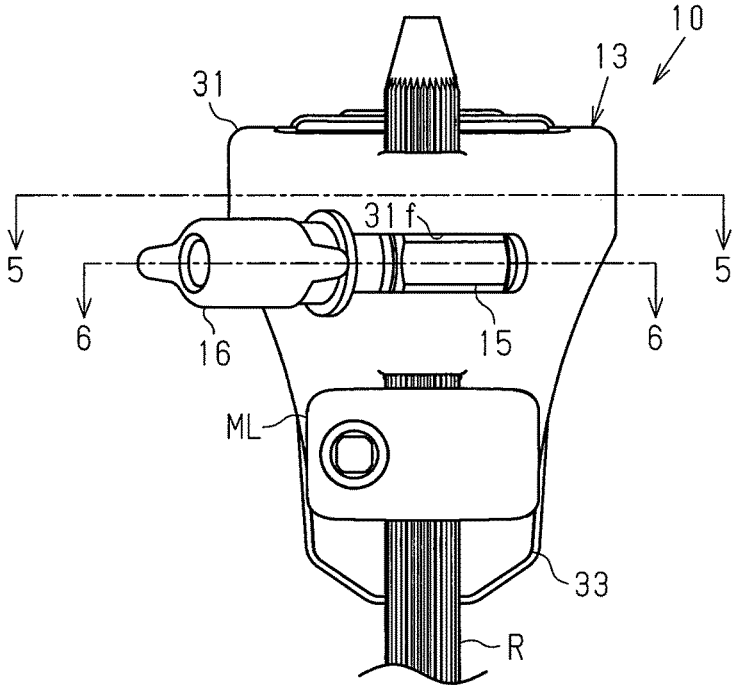
FIG. 4 is a front view of the bracket.
Figure 5:
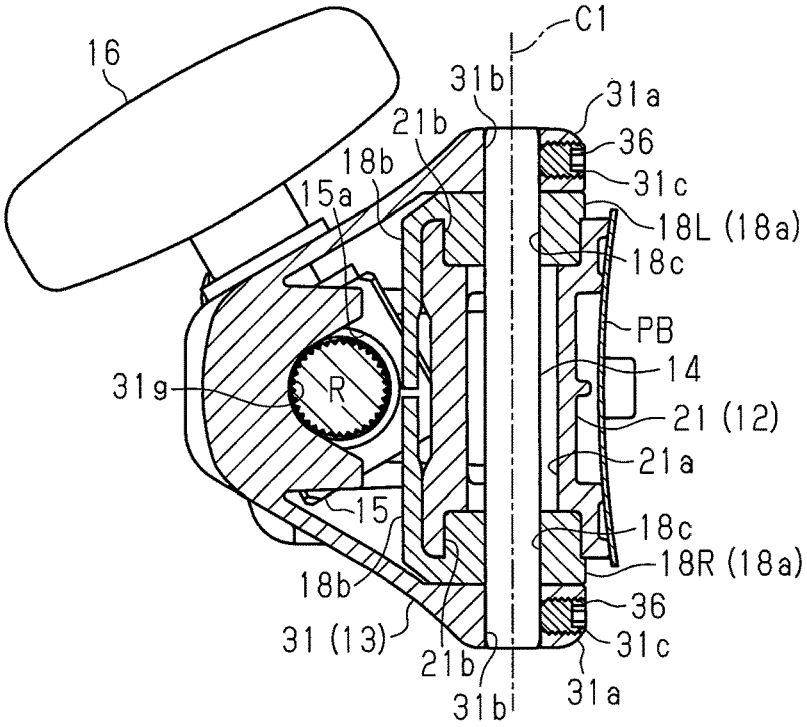
FIG. 5 is a cross-sectional view taken along line 5-5 of FIG. 4.
Figure 6:
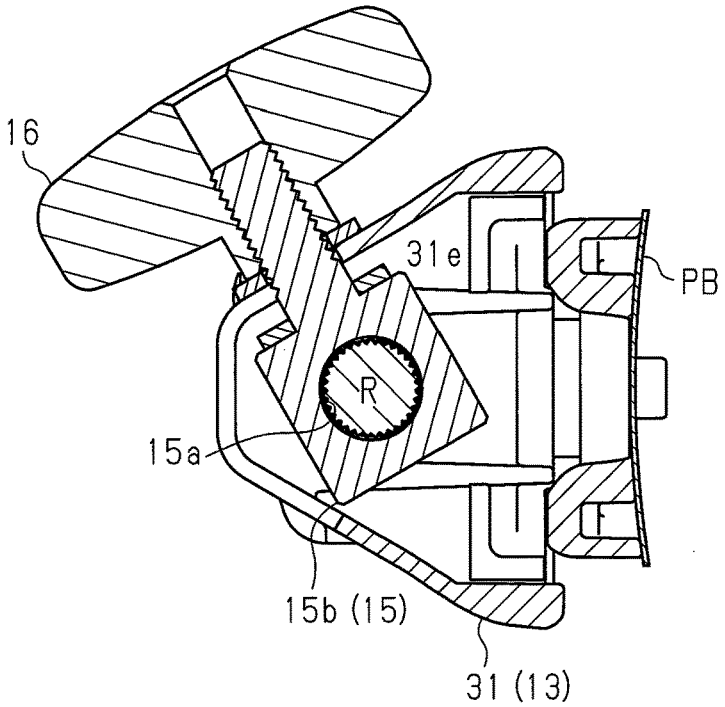
FIG. 6 is a cross-sectional view taken along line 6-6 of FIG. 4.
Figure 7:
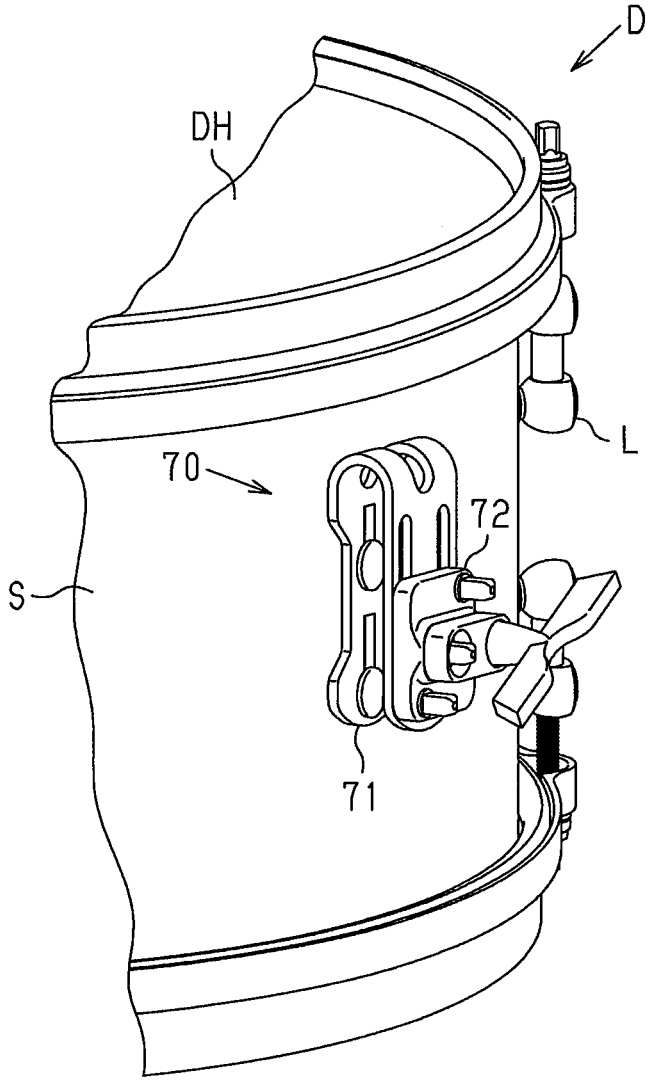
Fig.7(Related Art)
FIG. 7 is a perspective view of a drum including a conventional bracket.

As illustrated in FIGS. 3 to 5, an insertion hole 21*a*, through which a shaft 14 is inserted, is formed in the upper portion 21. The insertion hole 21*a* extends horizontally through the upper portion 21. The insertion hole 21*a* has a diameter greater than the diameter of the shaft 14 and is arranged coaxially with the shaft 14. The shaft 14 is thus arranged on the inner side of the insertion hole 21*a* while being separated from the inner circumferential surface of the insertion hole 21*a*. For example, the distance between the inner circumferential surface of the insertion hole 21*a* and the outer circumferential surface of the shaft 14 is set to a value that is approximately a half of the diameter of the shaft 14. Attachment holes 21*b*, to each of which the corresponding one of the second vibration absorbing members 18L, 18R is attached, are formed in the opposite sides of the upper portion 21. Each of the attachment holes 21*b* has a diameter that is greater than the diameter of the insertion hole 21*a*. Also, the attachment holes 21*b* communicate with the insertion hole 21*a* and are formed coaxially with the insertion hole 21*a*.

With reference to FIGS. 2 and 3, an attachment hole 23*b*, to which the first vibration absorbing member 17 is attached, is formed in the middle of the lower portion 23. The attachment hole 23*b* is formed in an annular shape that is sized substantially equal to the first vibration absorbing member 17 to be capable of receiving the entire first vibration absorbing member 17. Also, a projection 23*c*, which is inserted in a central hole 17*a* of the first vibration absorbing member 17, is formed in the attachment hole 23*b*.

The fixing member 13 includes a main portion 31 and a lower portion 33. The main portion 31 configures a coupling portion with respect to the base 12 and a fixing portion with respect to the rod portion R of the holder or the stand. The lower portion 33 extends downward from the main portion 31. The fixing member 13 is formed such that the main portion 31 is joined to the upper portion 21 and the pillar-shaped portion 22 of the base 12 and that the lower portion 33 is joined to the lower portion 23 of the base 12. The fixing member 13 also has a recess 34, in which the memory lock ML mounted to the rod portion R can be arranged.

As shown in FIGS. 2 and 5, the main portion 31 has two left and right arms 31*a*, which are coupled to the base 12. Insertion holes 31*b*, through which the shaft 14 is inserted, are each formed in the corresponding one of the arms 31*a*. The insertion hole 31*b* has a diameter that is substantially equal to the diameter of the shaft 14. Threaded holes 31*c*, which communicate with the insertion hole 31*b*, are each formed in the corresponding one of the arms 31*a*. Two left and right screws 36 are each fastened to the the threaded holes 31*c*. The screws 36 thus fix the fixing member 13 to the shaft 14 in a direction perpendicular to the axis C1 of the shaft 14.

With reference to FIGS. 2 and 3, a vertical hole 31*d*, through which the rod portion R is inserted, is formed in an upper wall of the main portion 31. An accommodating space 31*e*, in which the block body 15*b* of the screw 15 is accommodated, is formed in the interior of the main portion 31. An opening 31*f*, through which the distal end of the screw 15 is inserted, is formed in the front wall of the main portion 31. The opening 31*f* has a laterally elongated rectangular shape and extends both rightward and leftward from the middle of the front wall of the main portion 31. The opening 31*f* has a width that is slightly greater than the diameter of the distal end of the screw 15.

As shown in FIGS. 3 to 6, a recess 31*g* is formed in a section of the inner circumferential surface of a lower part of the main portion 31 that is opposed to the outer circumferential surface of the rod portion R. The recess 31*g* has an inner circumferential surface that has an arcuate cross section to match with a section of the outer circumferential surface of the rod portion R. The screw 15 is accommodated in the accommodating space 31*e* of the main portion 31 in a state in which the vertical hole 15*a* of the block body 15*b* is substantially aligned with the vertical hole 31*d* of the main portion 31 and the distal end of the screw 15 projects from the opening 31*f*. In this state, the wing nut 16, which is threaded to the distal end of the screw 15, is fastened to press the rod portion R against the wall of the recess 31*g* of the main portion 31 by means of the block body 15*b*. The fixing member 13 is thus fixed to the rod portion R.

The lower portion 33 has an attachment hole 33*a*, with which a front surface of the first vibration absorbing member 17 is held in contact. The attachment hole 33*a* is formed at the position corresponding to the attachment hole 23*b* of the base 12. Also, the lower portion 33, together with the outer surface of the lower part of the main portion 31, forms the recess 34, in which the memory lock ML is arranged.

The shaft 14 is joined to the base 12 and the fixing member 13 with the axis C1 extending horizontally. The shaft 14 is inserted through the insertion hole 21*a* and the attachment holes 21*b* of the base 12 and the two insertion holes 31*b* of the fixing member 13. As a result, the base 12 and the fixing member 13 are coupled to each other by the shaft 14 to be pivotal relative to each other about a horizontal axis. The horizontal axis, which is the axis of relative pivoting motion of the base 12 and the fixing member 13, thus coincides with the axis C1 of the shaft 14. The horizontal axis extends perpendicular to the axis of the cylindrical shell S of the drum D, which is shown in FIG. 1. Also, the horizontal axis is located in the vicinity of the middle of the upper portion 21 of the base 12 and in the vicinity of the upper end of the main portion 31 of the fixing member 13.

With reference to FIGS. 2 and 5, the second vibration absorbing members 18L, 18R are identically shaped and equally sized, except for that the second vibration absorbing members 18L, 18R are symmetrical in the left-right direction. Each of the second vibration absorbing members 18L, 18R has a substantially semi-columnar thick portion 18*a* and a plate-shaped thin portion 18*b*. Each of the thick portions 18*a* is attached to the corresponding one of the attachment holes 21*b* of the base 12. The thin portion 18*b* has a thickness smaller than the thickness of the thick portion 18*a*. An insertion hole 18*c*, through which the shaft 14 is inserted, is formed in the middle of each thick portion 18*a*. The second vibration absorbing members 18L, 18R are attached to the corresponding left and right sides of the base 12 such that the insertion holes 18*c* of the thick portions 18*a* are arranged coaxially with the attachment holes 21*b* of the base 12 and that the distal ends of the thin portions 18*b* are opposed to each other. That is, the second vibration absorbing members 18L, 18R are each arranged in the vicinity of the axis C1 of the shaft 14 and are attached to cover the upper portion 21 of the base 12 in the opposite, left and right directions.

In this state, the second vibration absorbing members 18L, 18R have the thick portions 18*a*, which are each attached to the corresponding attachment hole 21*b* of the base 12, as two left and right vibration absorbing portions that are separated apart in the axial direction of the shaft 14. Each of the thick portions 18*a* is arranged between the axis C1 of the shaft 14 and the base 12. Each of the thin portions 18*b* is arranged between the axis C1 of the shaft 14 and the fixing member 13 in a state in which a section of the thin portion 18*b* is held in tight contact with the outer surface of the base 12. On the other hand, the first vibration absorbing member 17 is located below the axis C1 of the shaft 14.

Referring to FIG. 3, the bracket 10 also includes a restricting portion 50, which restricts relative pivoting motion of the base 12 and the fixing member 13 about the axis C1 of the shaft 14. The restricting portion 50 is configured by an upper edge portion 12*d* of the base 12, an upper edge portion 13*d* of the fixing member 13, and an upper edge portion 18*d* of each second vibration absorbing member 18R, 18L, which is arranged between the upper edge portion 12*d* and the upper edge portion 13*d*. The respective upper edge portions 12*d*, 13*d*, and 18*d* are all located above the axis C1 of the shaft 14.

The upper edge portion 12*d* of the base 12 is formed as a protrusion that has a substantially triangular cross section. The upper edge portion 13*d* of the fixing member 13 is also configured by a protrusion and is formed in correspondence with the upper edge portion 12*d* of the base 12. The upper edge portion 12*d* of the base 12 and the upper edge portion 13*d* of the fixing member 13 are separated apart at a certain distance to form, between the upper edge portion 12*d* and the upper edge portion 13*d*, space in which the upper edge portions 18*d* of the second vibration absorbing members 18R, 18L are arranged.

The bracket 10 has the restricting portion 50 and is configured such that the upper edge portion 12*d* of the base 12 and the upper edge portion 13*d* of the fixing member 13 become immovable after approaching each other and clamping the upper edge portions 18*d* of the second vibration absorbing members 18L, 18R. That is, the bracket 10 is configured to, by means of the restricting portion 50, restrict relative pivoting motion of the base 12 and the fixing member 13 about the axis C1 of the shaft 14 exceeding a predetermined amount.

An operation of the above-described bracket 10 will now be described with reference to FIGS. 3 to 5.

As illustrated in FIGS. 3 to 5, the base 12 and the fixing member 13 are coupled to each other by the shaft 14 to be pivotal relative to each other about the axis C1 of the shaft 14. That is, the base 12 and the fixing member 13 are coupled to each other by the shaft 14 to be pivotal relative to each other about the horizontal axis, which is perpendicular to the axis of the shell S. As a result, vibration caused by striking the drum D is controlled to be the same as the direction of pivot about the horizontal axis, which coincides with the axis C1 of the shaft 14. That is, the vibrating direction of the drum D is controlled to be the same as the striking direction in which the drum D is struck. The sound of the drum D is thus unlikely to swell.

The second vibration absorbing members 18L, 18R are attached to the left and right sides of the base 12. In this state, the thick portions 18*a* are arranged between the axis C1 of the shaft 14 and the base 12. The thin portions 18*b* are arranged between the axis C1 of the shaft 14 and the fixing member 13. Further, the first vibration absorbing member 17 is, by being attached to the attachment hole 23*b* of the base 12, located below the axis C1 of the shaft 14. This arrangement allows the first vibration absorbing member 17 and the second vibration absorbing members 18L, 18R to absorb vibration caused by striking the drum D at the time the vibration is transmitted from the shell S to the bracket 10.

The present embodiment achieves the following advantages.

(1) The base 12 and the fixing member 13 are coupled to each other by the shaft 14 to be pivotal relative to each other about the horizontal axis, which is perpendicular to the axis of the shell S. When the drum D is played, this configuration enables vibration of the drum D as a whole about the horizontal axis in correspondence with the striking direction in which the drum D is struck. Also, in this case, the vibrating direction of the drum D is controlled to be the same as the striking direction of the drum D. The sound of the drum D is thus unlikely to swell. This improves the feeling of striking the drum D and the sound quality and resonance of the drum D, compared to a case in which the drum D is mounted using the conventional mounting device, which is incapable of controlling the vibrating direction of the drum D. Further, in this case, since the base 12 and the fixing member 13 are coupled to each other by the shaft 14 in the relatively pivotal manner, the drum D as a whole is allowed to reliably vibrate about the horizontal axis in correspondence with the striking direction in which the drum D is struck.

(2) The bracket 10 includes the first vibration absorbing member 17 and the two second vibration absorbing members 18L, 18R between the base 12 and the fixing member 13. In this configuration, the first vibration absorbing member 17 and the second vibration absorbing members 18L, 18R, which are arranged between the base 12 and the fixing member 13, absorb vibration caused by striking the drum D and thus restrain transmission of the vibration from the drum D to the mount object such as a holder or a drum stand. The sound quality and resonance of the drum D are thus further improved.

(3) The horizontal axis, which is the axis of relative pivoting motion of the base 12 and the fixing member 13, is located in the upper portion of the base 12 and the upper portion of the fixing member 13. The first vibration absorbing member 17 is located below the axis C1 of the shaft 14. In this configuration, the position of the horizontal axis is set in the vicinity of the main portion 31 of the fixing member 13 and the upper portion 21 of the base 12. This facilitates relative pivoting motion of the base 12 and the fixing member 13 about the horizontal axis. As a result, the drum D is allowed to properly vibrate about the horizontal axis in correspondence with the striking direction in which the drum D is struck. Also, in this case, since the first vibration absorbing member 17 is located below the horizontal axis, the first vibration absorbing member 17 is mounted to a non-coupling portion between the base 12 and the fixing member 13. The first vibration absorbing member 17 is thus allowed to efficiently absorb vibration from the drum D.

(4) The second vibration absorbing members 18L, 18R are attached to the left and right sides of the base 12. In this state, the thick portions 18*a* of the second vibration absorbing members 18L, 18R are arranged between the axis C1 of the shaft 14 and the base 12. The thin portions 18*b* of the second vibration absorbing members 18L, 18R are arranged between the axis C1 of the shaft 14 and the fixing member 13. In this configuration, not only is the first vibration absorbing member 17 located below the horizontal axis but also the second vibration absorbing members 18L, 18R are arranged both between the horizontal axis and the base 12 and between the horizontal axis and the fixing member 13. As a result, the bracket 10 as a whole is allowed to absorb vibration from the drum D. The vibration from the drum D is thus absorbed further efficiently.

(5) The first vibration absorbing member 17 and the second vibration absorbing members 18L, 18R are all made of elastic material. As a result, the vibration from the drum D is absorbed further efficiently. Also, the hardness of the first vibration absorbing member 17 is lower than the hardness of each second vibration absorbing member 18L, 18R. In this configuration, the second vibration absorbing members 18L, 18R, each of which has the relatively high hardness, are arranged in an upper portion of the bracket 10 while the first vibration absorbing member 17, which has the relatively low hardness, is arranged in a lower portion of the bracket 10. As a result, the relative pivoting motion of the base 12 and the fixing member 13 about the horizontal axis is further facilitated. This further facilitates adequate vibration of the drum D about the horizontal axis in correspondence with the striking direction in which the drum D is struck.

(6) The second vibration absorbing members 18L, 18R have the thick portions 18*a*, which are attached to the attachment holes 21*b* of the base 12, as the two left and right vibration absorbing portions that are separated apart in the axial direction of the shaft 14. In this configuration, the second vibration absorbing members 18L, 18R, each of which has the relatively high hardness, have the two left and right vibration absorbing portions. This restricts vibration of the drum D when the drum D sways in a manner parallel to or inclined with respect to the horizontal axis. This allows the vibrating direction of the drum D to be controlled to be the same as the striking direction.

(7) The bracket 10 includes the restricting portion 50, which restricts relative pivoting motion of the base 12 and the fixing member 13 about the axis C1 of the shaft 14. The restricting portion 50 is configured such that the upper edge portion 12*d* of the base 12 and the upper edge portion 13*d* of the fixing member 13 become immovable after approaching each other and clamping the upper edge portions 18*d* of the second vibration absorbing members 18L, 18R. As a result, even when the fixing member 13 is hit from below by the rod portion R of a holder or a drum stand, the fixing member 13 does not pivot relative to the base 12. This facilitates the work for fixing the rod portion R to the fixing member 13 and work for mounting the drum D to the holder or the drum stand.

(8) The opening 31*f* is formed in a laterally elongated rectangular shape and extends in the opposite, left and right directions from the middle of the front wall of the main portion 31. In this configuration, the wing nut 16, together with the screw 15, is movable in the opposite, left and right directions from the middle of the front wall of the main portion 31. By changing the position of the wing nut 16 in this manner, the wing nut 16 can be selectively fastened and loosened from both the left side and the right side of the bracket 10.

The present embodiment may be modified as follows.

The shaft 14 may be omitted from the bracket 10. In this case, a coupling portion may be arranged in both the base 12 and the fixing member 13 to couple the base 12 and the fixing member 13 directly to each other in a relatively pivotal manner. For example, each of the coupling portions may be configured by a columnar projecting portion and a hole or recess or tubular portion, which pivotally holds the projecting portion.

Either the first vibration absorbing member 17 or the second vibration absorbing members 18L, 18R or all of the first and second vibration absorbing members 17, 18L, 18R may be omitted. The shapes, locations, number and the like of the vibration absorbing members may be changed as needed.

The hardness of the first vibration absorbing member 17 may be equal to the hardness of each second vibration absorbing member 18L, 18R.

The restricting portion 50 is configured by the upper edge portions 12*d*, 13*d*, 18*d* of the base 12, the fixing member 13, and the second vibration absorbing members 18L, 18R, which are located above the axis C1 of the shaft 14. Instead, the restricting portion 50 may be configured by portions of the base 12, the fixing member 13, and the second vibration absorbing members 18L, 18R that are located coaxially with the shaft 14. Alternatively, the second vibration absorbing members 18L, 18R may be omitted and the restricting portion 50 may be configured simply by the base 12 and the fixing member 13.

Elastic components such as various types of springs, instead of elastic material, may be used for the first vibration absorbing member 17 and the second vibration absorbing members 18L, 18R. Alternatively, the first vibration absorbing member 17 and the second vibration absorbing members 18L, 18R may be configured by combining various types of springs.

The bracket 10 of the present invention may be configured to be mounted to any desired portion of the drum D including a portion of the hoop L and a portion of any one of the lugs L, instead of a portion of the shell S of the drum D.

The bracket 10 of the present invention may be employed in any desired drum as long as the drum is fixed to the rod portion R.

The invention claimed is:

1. A drum mounting device for mounting a drum to a mount object in which the drum is to be installed, the drum mounting device comprising:

a base, which is fixed to the drum;

a fixing member, which is joined to the base and is fixed to a pillar-shaped object arranged in the mount object;

a shaft that couples the base and the fixing member to each other and extends along a horizontal axis, which is perpendicular to an axis of a shell of the drum; and a vibration absorbing member arranged between the base and the fixing member, wherein the base includes an insertion hole through which the shaft is inserted and the fixing member includes an insertion hole through which the shaft is inserted, wherein the base includes a coupling portion to which the fixing member is coupled, wherein the base and the fixing member are coupled to each other to be pivotal relative to each other about the horizontal axis, which extends through the coupling portion, with the shaft inserted through the insertion holes of the base and fixing member, and wherein the horizontal axis is located in an upper portion of the base and an upper portion of the fixing member and the vibration absorbing member is located below the horizontal axis.

2. The drum mounting device according to claim 1, wherein the vibration absorbing member is one of a plurality of vibration absorbing members, and the vibration absorbing members include a first vibration absorbing member, which is located below the horizontal axis, and a second vibration absorbing member, which is arranged at least either between the horizontal axis and the base or between the horizontal axis and the fixing member.

3. The drum mounting device according to claim 2, wherein the vibration absorbing members are made of an elastic material, and a hardness of the first vibration absorbing member is lower than a hardness of the second vibration absorbing member.

4. The drum mounting device according to claim 2, wherein the second vibration absorbing member has two left and right vibration absorbing portions that are separated apart in the axial direction of the horizontal axis.

5. The drum mounting device according to claim 1, further comprising a restricting portion, in which a portion of the base and a portion of the fixing member that are located either at positions on the horizontal axis or positions above the horizontal axis approach each other, thereby restricting relative pivoting motion of the base and the fixing member about the horizontal axis.

6. A drum comprising a mounting device for mounting the drum in a mount object in which the drum is to be installed, wherein the mounting device includes:

a base, which is fixed to the drum; and a fixing member, which is joined to the base and is fixed to a pillar-shaped object arranged in the mount object;

a shaft that couples the base and the fixing member to each other and extends along a horizontal axis, which is perpendicular to an axis of a shell of the drum; and a vibration absorbing member arranged between the base and the fixing member, the base includes an insertion hole through which the shaft is inserted and the fixing member includes an insertion hole through which the shaft is inserted, the base includes a coupling portion to which the fixing member is coupled, the base and the fixing member are coupled to each other to be pivotal relative to each other about the horizontal axis, which extends through the coupling portion with the shaft inserted through the insertion holes of the base and fixing member, and the horizontal axis is located in an upper portion of the base and an upper portion of the fixing member and the vibration absorbing member is located below the horizontal axis.

* * * * *